United States Patent [19]

Santoli et al.

[11] 4,291,558

[45] Sep. 29, 1981

[54] PROCESS OF ROLLING IRON-SILICON STRIP MATERIAL

[75] Inventors: Pat A. Santoli, Natrona Heights.; Howard E. Baybrook, New Kensington, both of Pa.

[73] Assignee: Allegheny Ludlum Steel Corporation, Pittsburgh, Pa.

[21] Appl. No.: 61,323

[22] Filed: Jul. 27, 1979

[51] Int. Cl.[3] ..... B21B 3/02

[52] U.S. Cl. ..... 72/38; 72/202; 72/365; 148/111

[58] Field of Search ..... 72/38, 200, 202, 364, 72/365; 148/110, 111, 112, 113

[56] References Cited

U.S. PATENT DOCUMENTS

| | | | |
|---|---|---|---|
| 2,599,340 | 6/1952 | Littmann | 148/12.5 |
| 2,867,557 | 1/1959 | Crede | 148/111 |
| 3,345,219 | 10/1967 | Detert | 148/111 |
| 3,632,456 | 1/1972 | Sakakura | 148/112 |
| 3,843,422 | 10/1974 | Henke | 148/112 |
| 3,933,024 | 1/1976 | Matsumoto | 72/364 |
| 4,204,890 | 5/1980 | Irie | 148/111 |

*Primary Examiner*—Daniel C. Crane
*Assistant Examiner*—Gene P. Crosby
*Attorney, Agent, or Firm*—William J. O'Rourke, Jr.; Vincent G. Gioia

[57] ABSTRACT

An improved method is provided for reducing hot rolled band to final gage iron-silicon alloy steel strip material while retaining the magnetic properties of the strip material. In this method, the hot rolled band is passed through an intermediate and a final cold rolling operation to accomplish progressive reduction prior to final annealing of the material. The improvement of the present invention comprises heating the material between the intermediate and final cold rolling operations to a temperature and for a time of at least that necessary to recover the cold rolled structure and to relieve residual stresses in the intermediate cold rolled material and less than that at which grains of the material begin to recrystallize.

7 Claims, No Drawings

PROCESS OF ROLLING IRON-SILICON STRIP MATERIAL

BRIEF SUMMARY OF THE INVENTION

The present invention relates to the rolling of sheet material and, more particularly, to an improved method of rolling an iron-silicon alloy material through at least two separate cold rolling reducing operations to final gage without a loss of magnetic qualities. Specifically, the present invention is directed to a in-process recovery heat treatment at a low temperature and for a short duration as applied to strip material between a plurality of cold rolling reducing operations.

Various methods for producing silicon steel strip material are disclosed in the prior art, such as in Crede, et al. U.S. Pat. Nos. 2,867,557, Littmann 2,599,340 and Matsumoto et al. 3,933,024. In the production of iron-silicon steel strip, a slab may be preheated to a temperature of about 1600° to 2400° F., and hot rolled into strip material having a gage of about 0.060 to 0.160 inch. This material is often called hot rolled band, and the thickness is referred to as "the hot rolled band gage". After the hot rolling operation, the band may be annealed, pickled, dried, oiled and recoiled for further processing. Subsequently, the hot rolled band may be edge trimmed and passed through cold rolls to further reduce the gage. The strip material is typically reduced to an intermediate gage such as from 0.020 to 0.040 inch in a first cold rolling operation. The cold rolling operation may be performed on a mill such as a tandem mill having 3 to 5 roll stands, a single stand reversing mill or similar mill. The intermediate gage is then cold rolled to final gage in a second cold rolling operation which may also be performed in the same, or a different mill. Final gage for magnetic strip material is generally on the order of 0.006 to 0.018 inch. After rolling the final gage, the strip material is typically decarburized, coated and annealed.

Rolling of iron-silicon material from hot rolled band to final gage is performed in two separate cold rolling operations because of the limitations of a single cold rolling operation. These limitations, which may prevent full reduction of hot rolled band to final gage in one operation, include the power requirements, the type of drive mechanism employed, the work roll diameters, and the like. Therefore, it is common in the industry to first cold roll the hot rolled band to an intermediate gage, and then cold roll the intermediate gage material to final gage on either the same or another cold rolling mill.

The strip material may be heat treated between the intermediate and the final cold rolling stages. As disclosed in Henke, U.S. Pat. No. 3,843,422 such intermediate heat treatment, or annealing, may involve heating the material to a temperature of about 1725° F. for a time sufficient to recrystallize the grain structure. This heat treatment is considered necessary to remove the high residual stresses which have been created in the material during the first cold rolling operation. Without heat treatment, the material would split or crack, especially in longitudinal rolling direction, when subjected to the subsequent final cold rolling forces. This intermediate annealing operation which may be called a recrystallization heat treatment, relieves the stresses induced in the material during the initial cold rolling and permits continued cold rolling of the recrystallized material without undue difficulty. Such intermediate anneal has been found to be beneficial for the majority of strip materials, but requires significant energy requirements to attain the temperatures necessary to recrystallize the material. Although such heat treatment has the effect of permitting further cold reduction by removing residual stress, it has been considered necessary to recrystallize the grain structure of the material during such heat treatment in order to maintain the magnetic qualities of the final gage strip material.

In certain iron-silicon alloys, commonly called "high permeability steels," recrystallization heat treatments are not employed at any stage between hot rolled band gage and finish gage. However, when using two or more rolling operations to reduce such strip material, a substantial amount of strip breakage and yield loss occurs during the second rolling operation because of the brittle nature of the material.

Accordingly, an alternative, yet effective method of treating intermediate cold rolled magnetic strip material is desired which will permit further cold reduction of the strip while retaining the magnetic properties of the final product.

The present invention may be summarized as providing an improved method of reducing hot rolled band to final gage magnetic strip material while retaining the magnetic properties of the strip material. In this method, the hot rolled band is passed through an intermediate and a final cold rolling operation to accomplish progressive reduction prior to final annealing of the material. The improvement of this invention comprises heating the material between the intermediate and final cold rolling operations to a temperature sufficient for recovery of the cold worked structure and for relief of residual stress in the intermediate cold rolled material while substantially preventing recrystallization of the strip material.

Among the advantages of the present invention is the provision of a method of cold rolling magnetic strip material while maintaining its high magnetic quality.

An objective of this invention is to provide a method of stress relieving intermediate gage magnetic strip material without recrystallization, prior to final cold rolling by a heat treating operation which may be conducted in process.

Another advantage of the present invention is to provide a method of stress relieving intermediate gage iron-silicon strip material at comparatively low temperatures prior to cold rolling of the final gage material.

Another advantage of the present invention is to provide a method for recovery heat treatment of intermediate gage iron-silicon strip material at comparatively low temperature prior to cold rolling of the strip into final gage material.

A further advantage of the present invention is to provide a method for heat treatment of intermediate gage iron-silicon strip material at comparatively low temperature to improve the response of the material to applied stresses during final cold rolling.

These and other objectives and advantages of this invention will be more fully understood and appreciated with reference to the following detailed description.

DETAILED DESCRIPTION

As mentioned above, an intermediate anneal of strip material has been found beneficial to relieve high residual stresses which have been created in an intermediate cold rolling operation. However, such anneal is conducted at such high temperatures that it results in recrystallization of the intermediate gage material.

The present invention is directed to an improved method of reducing hot rolled band of magnetic material to final gage product through two separate cold rolling operations. The magnetic materials comprehended by the present invention include iron-silicon alloy steels, such as oriented silicon steels having a silicon composition of from 2.0 to 5.0% and preferably from 3.00 to 3.50%. These iron-silicon alloys exhibit increased electrical resistivity, and high permeability in the annealed condition. A common use for such materials in the strip condition, is the employment in transformer cores. When used as transformer cores, such materials exhibit significantly reduced core losses. Maintaining magnetic properties, such as permeability, is a beneficial goal which may be accomplished by the method of the present invention.

The process of hot rolling of steel into hot rolled band is well known in the art. Hot rolling of steel slabs, preheated to about 1600° to 2400° F. typically may reduce sheet material to hot rolled band having a thickness on the order of 0.060 to 0.160 inch. In the production of strip material, final reduction is typically accomplished by cold rolling. Cold rolling of the hot rolled band involves the passing of unheated strip material through rolls for the purpose of further reduction in gage.

Cold reduction may be accomplished in a plurality of separate reducing operations, such as by a number of passes of the strip material through a tandem cold mill. Cold reduction is usually on the order of from 25 to 90% of the entering strip thickness. Specifically, hot rolled band having a 0.060 to 0.160 gage may be reduced in an intermediate cold rolling operation to 0.020 to 0.040 inch, and may be further reduced to 0.006 to 0.018 inch in a final cold rolling operation. Typically, the strip is subjected to an intermediate recrystallization heat treatment, or anneal, between the intermediate and final cold rolling operations to enable final cold rolling without failure. Without the intermediate heat treatment, the subsequent cold rolling operation tends to cause the strip material to fail, i.e., to exhibit cracks and splits in the longitudinal and/or transverse rolling direction when subjected to the subsequent cold rolling forces.

The present invention is directed to an improved method of producing final gage iron-silicon strip material in which the material is subjected to a low temperature heat treatment between intermediate and final cold reductions which avoids recrystallization yet promotes the efficient final reduction without failure. What is especially unique about the improved method of the present invention is that by avoiding recrystallization of the strip material, by a controlled recovery heat treatment operation, the magnetic properties of the final annealed product are maintained as compared to the magnetic strip material rolled in accordance with the prior art process.

In the present invention, intermediate gage material is heated to a temperature which promotes recovery of the cold worked structure and relieves the residual stresses created during the intermediate cold rolling operation. But, importantly, this intermediate heat treating temperature and times must not be sufficient to allow the material to recrystallize substantially. It has been found that a temperature in the range of about 300° F. to 1100° F. may be employed to accomplish this heat treatment which renders the material amendable to final cold rolling without failure. It has also been found that conventional electrical steels, i.e., oriented silicon steels, tend to recrystallize when exposed to temperatures in excess of 1150° F. for any excessive period of time such as 30 to 45 seconds. Therefore, although the intermediate heat treatment temperature should not substantially exceed 1100° F., exceeding such temperature for short durations, such as less than 10% of the total heat treating time, does not permit substantial recrystallization of the material.

Typical intermediate heat treatment times may be from thirty seconds to sixty minutes at the required temperatures, to accomplish the required recovery of the cold worked structure and the required stress relief. It will be understood by those skilled in the art that times and temperatures will vary inversely, with respect to one another, in the process of the present invention.

To determine if recovery and stress relief has occurred by heat treatment is a matter of special test procedure using samples of the material. Conducting tension tests may provide an indication of the effect of heat treatment in terms of an increase in ultimate tensile strength. The test should be conducted by pulling one end of a test specimen at a rate of about 10 inches per second crosshead speed, while using a specific test specimen geometry. The preferred dimensions for such specimen include an overall length of about 5½ inches, with a width of about 1¼ inch at the flanges at each end of the specimen. The flanges taper through a 1¼ inch radius to a centrally located reduced section ¼ inch long and ¼ inch wide. One skilled in the art may also discern that recovery of the cold worked structure has occurred by observing a specimen of the heat treated material through an electron microscope. Magnification of 20,000X can readily show changes in the substructure indicative of the recovery process. The observed changes should show a reduction in the density of dislocations present and a rearrangement of such dislocations in a geometric pattern, such as into polygonal networks with low angle subgrain boundaries. Low angles, such as less than 20°, are indicative of recovery without recrystallization, while high angles are indicative of high annealing temperatures which cause recrystallization.

Determination of whether the grains of the material have recrystallized may be routinely accomplished by observing the material, such as through an electron microscope, at a magnification of about 10,000X. It will be understood that the recrystallization of a few grains shall not adversely affect the material heat treated in accordance with the present invention.

Additionally, the intermediate heat treatment must be performed in a non-oxidizing atmosphere. Such atmosphere may be 100% nitrogen, or a mixture of hydrogen and nitrogen, or an inert atmosphere. It will be further understood in the art that degreasing and cleaning treatments may be performed prior to the intermediate recovery and stress relief heat treatment of the material as may be desired.

In practicing the method of the present invention, an intermediate cold rolled, oriented silicon steel was subjected to a low temperature heat treatment in accordance with the present invention. The strip was recovery heat treated without recrystallization, by consecutively passing the strip through seven zones of a radiant tube heated section then through eleven zones of an electric soak section. The furnace temperatures shown in the table below indicate the temperatures in the radiant tube and in the electric soak sections respectively.

TABLE I

| Furnace Temperature (°F.) | Strip Speed (Ft./Min) | Intermediate Strip Gage (inch) | Max. Strip Temp. (°F.) | Heat Treat Time |
|---|---|---|---|---|
| 1150/900 | 150 | .024 | 900 | 103 sec. at 900° F. |
| 1150/900 | 112 | .024 | 1000 | 20 sec. at 1000° F. |
| | | | | 193 sec. at >900° F. |
| 1050/825 | 160 | .026 | 750 | 58 sec. at >700° F. |
| 1050/825 | 140 | .026 | 765 | 85 sec. at >700° F. |
| 1050/850 | 112 | .026 | 820 | 55 sec. at >800° F. |
| | | | | 143 sec. at >700° F. |

The magnetic properties of the final gage material were compared with similar strip material which had not received the low temperature heat treatment as required by the present invention. The following table shows that the magnetic properties of the strip material of the present invention are comparable with the magnetic properties of strip material of the prior art which were cold rolled without the intermediate recovery heat treatment of the present invention.

TABLE II

| | Intermediate Gage (inch) | Final Gage (inch) | Sample Size (No. of coils) | Magnetic Properties WPP at 17 kb Good end | WPP at 17 kb Poor end | Mu at 10 H Poor end |
|---|---|---|---|---|---|---|
| Present Invention | .024 | .011 | 12 | .716 | .747 | 1875 |
| Prior Art | .024 | .011 | 16 | .675 | .695 | 1891 |
| Present Invention | .026 | .011 | 12 | .658 | .692 | 1887 |
| Prior Art | .026 | .011 | 14 | .662 | .717 | 1881 |

An indication of a benefit from heat treatment in accordance with the present invention was also found in a reduction in the number of breaks in the coils of strip material during final cold rolling. In the production of the strip material of the present invention 42.8% of the coils were produced without breaks. As a comparison, only 18.5% of the coils of strip material cold rolled without the intermediate recovery heat treatment of the present invention had no breaks.

The low temperature, recovery heat treatment of the present invention also provides more ductile edge portions of the strip material which promotes more efficient edge trimming, and collection of the edge scrap. Also, the recovery heat treatment allows the strip material to lie flatter which benefits the edge trimming and the rolling operation with a possible increase in the final rolling speed.

Whereas the particular embodiments of this invention have been described above for the purposes of illustration, it will be apparent to those skilled in the art that numerous variations of the details may be made without departing from the invention.

What is claimed is:

1. An improved method of reducing hot rolled band to final gage iron-silicon alloy steel strip material to retain the magnetic qualities of the final gage strip material in the annealed condition, comprising the steps of passing the material in an intermediate and in a final cold rolling operation to accomplish progressive gage reduction prior to final annealing of the material, wherein the improvement comprises:

heating the material between the intermediate and the final cold rolling operations in a non-oxidizing atmosphere to a temperature and for a time of at least that necessary to recover the cold worked structure in the material and to relieve residual stresses in the material and less than that at which grains of the material begin to recrystallize.

2. A method as set forth in claim 1 wherein the non-oxidizing atmosphere comprises a gas selected from the group consisting of hydrogen, nitrogen, and mixtures thereof.

3. A method as set forth in claim 1 wherein the intermediate gage is from 0.020 to 0.040 inch.

4. A method as set forth in claim 1 wherein the final gage is from 0.006 to 0.018 inch.

5. A method as set forth in claim 1 wherein the hot rolled band gage is from 0.060 to 0.160 inch.

6. An improved method of reducing hot rolled band to final gage iron-silicon alloy steel strip material to retain the magnetic qualities of the final gage strip material in the annealed condition comprising the steps of passing the material through both an intermediate and a final cold rolling operation to accomplish progressive gage reduction prior to final annealing of the material, wherein the improvement comprises:

heating the material between the intermediate and the final cold rolling operations to a temperature of from about 300° F. to about 1100° F., for a period of from about thirty seconds to sixty minutes in a non-oxidizing atmosphere, to recover the cold worked structure in the material and to relieve residual stress in the intermediate cold rolled material while substantially preventing recrystallization of the material.

7. An improved method of reducing a hot rolled band of iron-silicon alloy steel to final gage to retain the magnetic properties of the final gage strip material in the annealed condition comprising the steps of:

passing the hot rolled band through an intermediate cold rolling operation to reduce the hot rolled band from a gage of about 0.060 to 0.160 inch to an intermediate gage of about 0.020 to 0.040 inch, passing the intermediate gage material through a final cold rolling operation to reduce the strip from an intermediate gage of about 0.020 to 0.040 inch to a final gage of about 0.006 to 0.018 inch, decarburizing the material at a temperature of about 1450° F. to 1500° F., coating the material with a magnesium oxide (MgO) powder, and annealing the final gage strip material at a temperature of about 2000° F. to 2300° F., wherein the improvement comprises:

heating the intermediate gage strip material prior to introduction into the final cold rolling mill to a temperature of from about 300° F. to about 1100° F. for a time of from about thirty seconds to about ten minutes in a non-oxidizing atmosphere, to recover the cold worked structure of the strip material and to relieve residual stresses in the intermediate gage strip material while preventing recrystallization of the strip material.

* * * * *